United States Patent [19]

O'Neil

[11] 4,117,625

[45] Oct. 3, 1978

[54] ROPE SPINNING TOY

[76] Inventor: James R. O'Neil, 100-36th Ave., San Francisco, Calif. 94122

[21] Appl. No.: 810,607

[22] Filed: Jun. 27, 1977

[51] Int. Cl.[2] ..... A63H 1/32

[52] U.S. Cl. ..... 46/51; 46/1 G; 24/129 B

[58] Field of Search ..... 46/47, 48, 49, 50, 51, 46/52, 1 G; 40/21 R, 316, 305; 24/129 D, 129 B, 129 R, 128

[56] References Cited

U.S. PATENT DOCUMENTS

| | | | |
|---|---|---|---|
| 858,555 | 7/1907 | Altick | 24/129 B |
| 1,613,635 | 1/1927 | Zimmerlund | 24/129 B |
| 2,486,609 | 11/1949 | O'Neil | 46/1 G |
| 2,947,108 | 8/1960 | Dodd, Jr. et al. | 46/77 |
| 2,968,117 | 1/1961 | Trombly | 46/1 G |

*Primary Examiner*—Louis G. Mancene
*Assistant Examiner*—Mickey Yu
*Attorney, Agent, or Firm*—Robert G. Slick

[57] ABSTRACT

A rope spinning toy is provided having a spindle which can be grasped at either end and wherein one portion of the spindle is longer than the other and can be shortened by the user so that as the user becomes more expert, the spindle can be shortened. In accordance with one embodiment of the invention, an improved form of loop closure or honda is also provided which permits a light weight cord such as venetian blind cord of small diameter to be used to simulate certain rope-spinning feats that are customarily performed only with a heavier rope or lariat.

2 Claims, 8 Drawing Figures

ROPE SPINNING TOY

SUMMARY OF THE INVENTION

The present invention is an improvement over that of my prior Pat. No. 2,486,609. In my prior patent I described and claimed a rope spinning toy having a swivel with two handles, either one of which may be grasped, enabling the operator to use either hand at will or to transfer from one to the other while the rope is in use.

The toy previously described was somewhat difficult to assemble and use in that there was substantially no additional weight at the junction between the stem and the loop. In accordance with the present invention, an improved form of connection or honda is provided for forming the loop which is easy to assemble, even for a blind person.

The honda of the present invention permits a light weight cord to be used. The lightness of the cord should be stressed since unlike a rope or lariat it permits the performing of many string-and-finger tricks which involve the pulling of loops through one's fingers, the forming of intricate figures, a few sleight-of-hand maneuvers and some string puzzles. Also a certain "twistableness" is essential to the performance of two of my toy's specially featured spinning tricks, e.g. the "dropping the loop" trick, mentioned later.

Thus I provide a "rope-spinning type" toy of light weight cord having a swivel with two handles each of which is of just sufficient length to be readily grasped without touching the cord itself with the fingers. The main purpose of this two-handled swivel is not merely to enable the performer to "change hands" but to facilitate the maneuvering of the toy's loop into a spinning position around his upraised forearm. This is accomplished with the toy as described in my previous U.S. Pat. No. 2,486,609 in the following manner: Holding the swivel — or "spindle" — in a vertical position by its upper end with the loop dangling below, he slowly swings the "juncture" where the loop attaches to the extending "stem" into a small flat circle, gradually accelerating the movement so as to force the juncture into a widening circle. At the point where the circle formed becomes the actual size of the loop, the loop assumes a horizontal spinning position. By raising the spinning loop as high as possible while bending his wrist downward so as to keep the spindle verticle, it is then possible to reach the other hand up inside the loop and take hold of the spindle's lower end while continuing the controlling action from above. At this point he may release the upper end of the spindle and thus have the loop in an around-the-arm spinning position.

Although the feat just described is readily performable, many learners find the practice necessary to its achievement somewhat discouraging. In my new invention, Iprovide "break-away" extensions to the lower end of the spindle which will take the novice through step-by-step "training" toward ultimate mastery of the around-the-arm spin. He simply begins by taking hold of the lowest extension of the spindle in a loop he is already spinning from above. When he can do this with sufficient ease, he just snaps off that section and goes on from there with the shortened handle. His proficiency thus develops in stages until he finds himself performing expertly with the regular or "standard" spindle.

The connector or honda at the juncture of loop and "stem" has a number of functions and purposes in the mechanics of this toy:

It provides a slight weight which is a factor in putting the loop into a spin.

Allowing the length of stem and diameter of loop to be relatively adjusted; it is non-slippable to the extent that it renders the toy safe (no slip-noose).

Its design allows a final "finger assembly" of the toy without the use of tools. With an "eye" already formed on either end of the cord, final assembly consists simply of passing one eye through the other, affixing the connector by passing the stem's collapsed eye through two of its holes. then slipping the spindle into place at the stem's end. (In fact, this toy is ideally suited to be sold "knocked down" with simple assembling instructions included for the purchaser to follow. Or, even including the forming of the eyes at the cord's ends, the entire toy can readily be produced by blind workers).

A particular function that this piece is specially designed to fulfill is to hold the stem at a proper angle from the loop, i.e. pointing to the apex of an imaginary cone. With this fixed angle the spinning of the loop is non-directional, which is to say it does not matter in which direction a spin is started.

This proper angle of the stem in relation to the loop is essential to the trick of dropping a spinning loop from around the arm to a position below the hand. With the loop around his upraised forearm, the spinner may quickly withdraw his arm, allow the horizontally spinning loop to drop past his hand as he inverts the spindle are resumes control from above it. The mechanics of this feat require the connector, with the stem leading directly from it, to "twist" the loop's cord on its own axis through a full 360° turn. It is the shape of the connector extending as it does slightly from the loop's cord that gives the stem the necessary leverage to accomplish this twisting action. Otherwise, without the 90° angle and the connector's slightly extended shape, the stem would simply wrap around the loop's cord at that point. The reverse of this trick, flipping a loop spinning below the hand upward into the around-the-arm position necessitates the same twisting action of the loop's cord.

Various other objects and features of the invention will be described in the balance of the specification.

DESCRIPTION OF THE PREFERRED EMBODIMENTS

Figure 1:
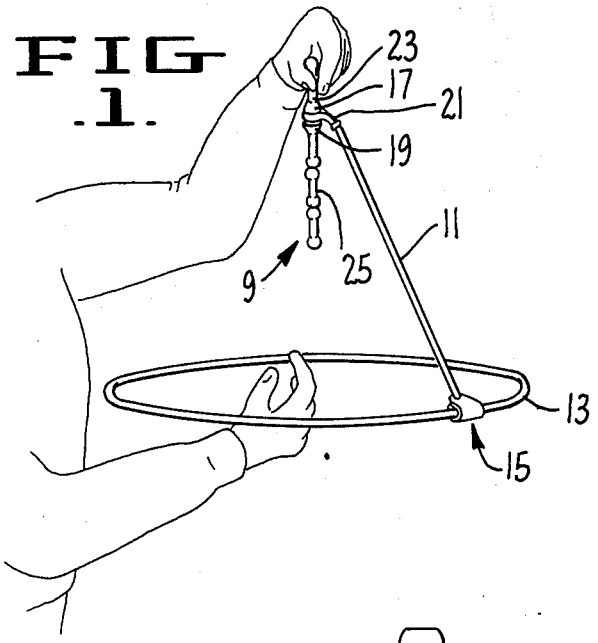
FIG. 1 is a perspective view of a device embodying the present invention showing the user grasping it by the upper handle.

Referring now to the drawings by reference characters, the device of the present invention constitutes three main parts, namely, a spindle 9, a stem 11 and a loop 13. It will be recognized, of course, that the stem 11 and loop 13 are formed of a single piece of light cord held in proper relationship by means of the connector or honda generally designated 15, later described in detail. In the embodiment shown, the spindle 9 has formed integrally thererwith an upper hub 17 and a lower hub 19 separated by a sufficient distance that a loop 21 formed at the upper end of the stem can freely turn on the spindle yet will be prevented from sliding off by means of the hub. Mounted above the hubs is the upper handle 23 which is relatively short and the lower handle 25 which is relatively long. The lower handle 25 is formed with breakable connections at 27 and 29 so that the lower handle 25 can be of any of three desired lengths merely by breaking off the excess sections.

Figure 2:
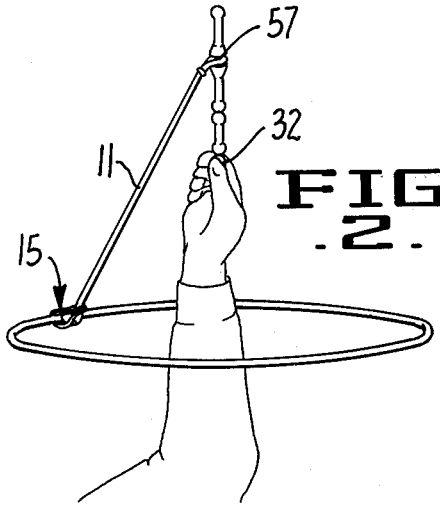
FIG. 2 is a view similar to FIG. 1 but showing the position of the hand after the user has grasped the top by the lower handle.
Figure 3:
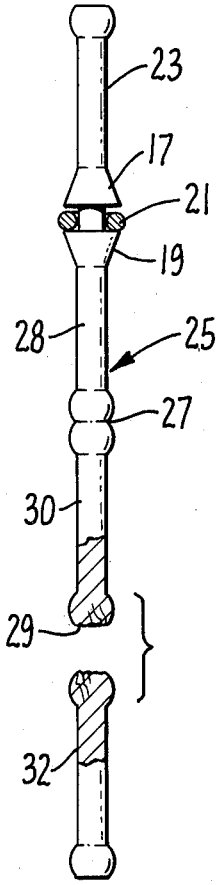
FIG. 3 is an enlarged view of the spindle showing one embodiment where the handle is broken away as the spindle is shortened.

As was pointed out above, the longer the lower portion of the handle, the easier it is for a beginner to change hands. Thus referring particularly to FIGS. 1 and 2, the beginner would start with all three sections in place starting the twirling operation as is shown in FIG. 1 and then would change hands by placing the oppposite hand through the loop, grasping the lowest segment 32 of the handle. Then as the user became adept, he would break off the handle 32, along the parting line 29 as is shown in FIG. 3, and then when he changed hands would grasp the section 30. Again, as he became adept at this maneuver, he would break the spindle at the weakened portion 27 and would then grasp portion 28. Thus, the toy is made simple for the beginner yet retains the challenge as the user can make it more difficult as he becomes as expert with the longer spindle.

The break-away feature can take different forms. In FIG. 3 the spindle is shown as it might be made of wood or plastic with weakened portions 27 and 29 which can be easily broken at the desired point merely by twisting the spindle on each side of the weakened portion.

Figure 4:
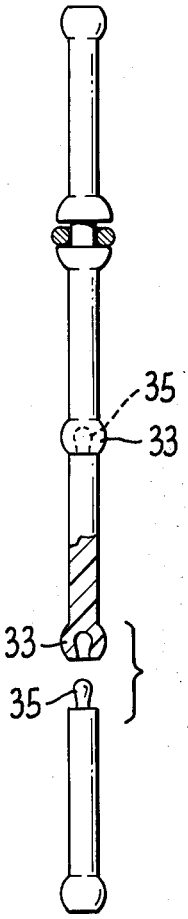
FIG. 4 is a view of an embodiment of the spindle wherein the parts snap together so that even after the spindle has been shortened it can be easily restored to its former length.

FIG. 4 another embodiment is shown and each of the segments below the swivel is formed with a socket 33 at its lower end and a mating pin 35 at its upper end. Pin 35 has a bulbous end so that it can be snapped into socket 33 and will be retained in this position until forcefully removed. This structure has the advantage that the spindle is not permanently shortened and it can be shortened or lengthened at will depending upon the skill of the user.

Figure 5:
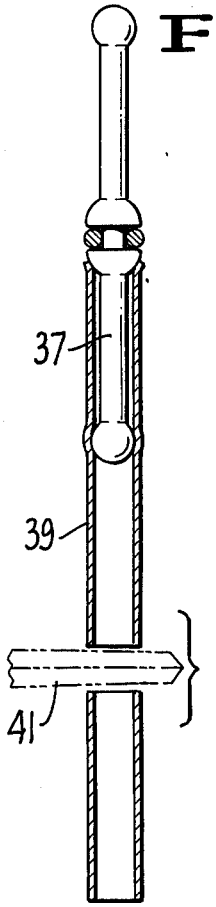
FIG. 5 is a sectional view of another embodiment of the spindle wherein a tube of cardboard of the like forms an extension of the lower end of the spindle and which can be cut to a desired length.

In the embodiments shown in FIG. 5, the lower handle 37 is provided with an extension tube 39 which merely slips over the handle and is held in place by friction. The tube 39 can be made of a material which is easily cut such as cardboard or relatively thin plastic. Now as the user becomes more adept, the spindle can be shortened merely by snipping it off to a desired length using scissors 41. Instead of snipping off the tube 39, it can be merely slipped off of the handle 37 in order to provide the short spindle.

Figure 6:
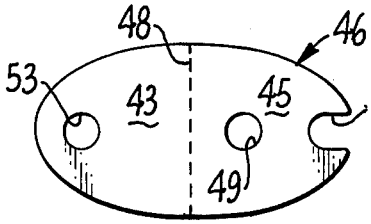
FIG. 6 is a plan view of the honda connector.
Figure 7:
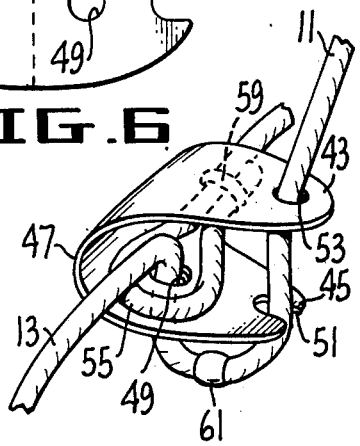
FIG. 7 is an enlarged perspective view of the connector showing the method of fastening the rope to the connector.
Figure 8:
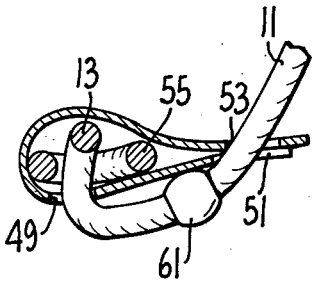
FIG. 8 is a section through the center of the connector of FIG. 6.

In accordance with a preferred embodiment of the invention, an improved form of connector or honda is provided which is shown in detail in FIGS. 6, 7 and 8. This consists of an elongated piece of leather or plastic 46 which is formed as a U by bending near dotted line 48 providing the arms 43 and 45 of the U connected by the bight portion 47. Arm 45 has a first hole 49 near the bight and a second hole or slot 51 near the terminal end of the arm. Arm 43 has a mating hole 53. The cord from which the toy is to be fabricated is provided with a loop at either end, the loops being designated 55 and 57. The loops can be conveniently formed by use of a metal clip 59. In addition, the cord can be provided with a small weight 61 which serves both to make the toy easier to operate and also as an aid, particularly for a blind person, in assembling the toy to achieve proper relationship between the loop and the stem. The toy is assembled by placing the loop 55 over the hole 49 and passing the loop 57 through the loop 55, hole 49 and then back through the slot or hole 51 and the hole 53. This provides a convenient connection which can be easily assembled by a blind person and which provides the right angular relationship between the stem and the loop and also which provides a small amount of weight at the end of the stem making it easier for a beginner to learn the use of the toy.

Various variations can be made in the exact structure shown without departing from the spirit of this invention. For instance, in FIG. 3 the lower portion of the spindle has been shown as divided into three portions. Obviously a greater or smaller number of sections could be used.

I claim:

1. A rope spinning toy having a honda wherein said honda includes a U-shaped member of a flexible material having a first end and a second end with a bight between the ends with a first hole near the end in said first end, a second hole near the bight of the second end and a notch in the end of the second end of said U a cord having a loop at one end of said cord over said second hole within said U, the opposite end of said cord being brought through said loop, through said second hole, through said notch and then through said first hole to form stem and loop of the toy.

2. The structure of claim 1 wherein the cord has a weight near the honda.

* * * * *